US006679720B2

(12) United States Patent
Nakamura et al.

(10) Patent No.: US 6,679,720 B2
(45) Date of Patent: Jan. 20, 2004

(54) CONNECTOR AND A METHOD FOR ASSEMBLING A CONNECTOR

(75) Inventors: Hideto Nakamura, Yokkaichi (JP); Kei Yanagisawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/074,742

(22) Filed: Feb. 12, 2002

(65) Prior Publication Data

US 2002/0115323 A1 Aug. 22, 2002

(30) Foreign Application Priority Data

Jul. 25, 2001 (JP) ..... 2001-224823

(51) Int. Cl.[7] ..... H01R 13/627
(52) U.S. Cl. ..... 439/357; 439/352
(58) Field of Search ..... 439/299, 310, 439/353, 357, 352

(56) References Cited

U.S. PATENT DOCUMENTS 5,234,356 A * 8/1993 Maejima et al. ..... 439/352
6,135,802 A 10/2000 Nakamura ..... 439/352
6,533,600 B1 * 3/2003 Kashiyama et al. ..... 439/352
6,533,601 B2 * 3/2003 Raudenbush et al. ..... 439/352

FOREIGN PATENT DOCUMENTS

DE 197 14 459 A1 10/1998
EP 0 583 056 A1 6/1993

* cited by examiner

*Primary Examiner*—Renee Luebke
(74) *Attorney, Agent, or Firm*—Anthony J. Casella; Gerald E. Hespos

(57) ABSTRACT

A connector includes male and female connector housings (10, 20). The male housing (10) has a receptacle (11) and a lock arm (15) projects into the receptacle (11) for locking the female housing (20). A slider (34) is assembled into the female housing (20) and is biased forwardly by coil springs (33). The lock arm (15) is resiliently deformable between an engaging position where it is engageable with the slider (34) and a disengaging position where it is disengaged from the slider (34). If a connecting or separating operation is interrupted halfway, spring forces accumulated in the compression coil springs (33) resiliently compressed by the slider (34) are released. Thus, the lock arm (15) is pushed forward by the slider (34) to separate the housings (10, 20) from each other.

13 Claims, 7 Drawing Sheets

CONNECTOR AND A METHOD FOR ASSEMBLING A CONNECTOR

BACKGROUND OF THE INVENTION

1. Field of the Invention

The invention relates to a connector and to a method for assembling a connector so that a connection detecting function may be performed.

2. Description of the Related Art

A connector with a connection detecting function is disclosed in U.S. Pat. No. 6,135,802 and also is shown in FIG. 9 herein. The connector includes a female housing 1 that can be connected to a male housing 2. The female housing 1 has a lock arm 3 that can be engaged with the male housing 2 to hold the housings 1, 2 in their connected condition. A slider 4 is mounted in the male housing 2 and a coil spring 5 is disposed between the rear wall of the male housing 2 and the slider 4 for urging the slider 4 forwardly. The lock arm 3 is deformed resiliently while the housings 1, 2 are being connected and the deformed lock arm 3 pushes the slider 4 against a biasing force of the coil spring 5. The lock arm 3 is restored resiliently to its original shape when the housings 1, 2 are connected properly. This resilient restoration causes the lock arm 3 to engage the male housing 2 and to separate from the slider 4. Thus, the housings are locked together and the slider 4 is returned to its initial position by the biasing force of the coil spring 5.

Connection of the housings 1, 2 may be interrupted when the housings 1, 2 are connected only partially. In this situation, the biasing force of the coil spring 5 pushes the slider 4 and urges the lock arm 3 back to separate the housings 1, 2 from each other. This separating movement provides an indication that the housings 1, 2 were left partly connected.

The housings 1, 2 may require disconnection from each other for maintenance or for some other reason. Thus, a technician deforms the lock arm 3 an d pulls the female housing 1 to separate the housings 1, 2. Pulling forces on the female housing 1 may be interrupted and the housings 1, 2 may be left only partly connected during a separating operation. Partial connection of the housings during the separating operation cannot be detected in the conventional connectors, and connectors capable of making such a detection have been hoped for.

The present invention was developed in view of the above situation and an object thereof is to enable a partial connection detection preferably both during a connecting operation and during a separating operation.

SUMMARY OF THE INVENTION

The invention is directed to a connector with first and second connector housings that are connectable with each other. A slider is assembled into the first connector housing and is movable forward and backward substantially along connecting and separating directions of the connector housings. An engaging portion is provided in the second connector housing and is resiliently or elastically displaceable between a first position and a second position when the connector housings are connected properly. The slider comprises an operable portion for moving the slider to a position where displacement of the resilient engaging portion to the first position is permitted. The second connector housing comprises a notch into which the operable portion is slideably insertable.

The two positions of the resilient engaging portion and the easy movement of the slider permitted by the insertion of the operable portion into the notch enable detection of a partial connection of the connector housings.

The resilient engaging portion preferably is resiliently displaceable in a direction that intersects the connecting and separating directions. Thus, in a first position, the resilient engaging portion engages the slider along the connecting and separating directions. However, in a second position, the resilient engaging portion is disengaged from the slider along the connecting and separating directions.

The slider is engaged with the resilient engaging portion that is located in the first position and is moved backward and away from the second connector housing. This backward movement preferably is against a biasing force of a biasing means, and occurs both at an intermediate stage of connecting the connector housings and at an intermediate stage of separating the connector housings.

The resilient engaging portion preferably is displaced resiliently to the second position and is disengaged from the slider when the connector housings are connected properly. Thus, the slider may be moved forward by the release of the biasing force accumulated in a biasing means.

The second connector housing preferably comprises a receptacle into which the first connector housing is insertable, and the notch is provided in the receptacle. The notch preferably extends from a front end of the receptacle along connecting and separating directions of the connector housings.

The connected connector housings are separated by moving the slider back against the biasing force of the biasing means. If the separating operation is interrupted halfway, the forwardly biased slider engages the resilient engaging portion to separate the connector housings. As a result, partial connection can be detected. In this way, partial connection can be detected both during the connecting operation and during the separating operation.

The operable portion preferably is provided at the rear end of the slider, and opposite sides of the upper wall surround the operable portion. Accordingly, external objects are unlikely to interfere with the operable portion. Additionally, the operable portion can extend through the notch to outside, and can be manipulated easily from outside, e.g. by a finger, a jig, or the like.

The operable portion preferably is provided at the rear end of the slider. Additionally, the notch of the receptacle can be shorter than a case where the operable portion is at a front end position or a middle position with respect to forward and backward directions. Thus a reduction in the strength of the receptacle can be suppressed.

An accommodation space may be provided on an outer surface of the first connector housing for at least partly accommodating the slider. The biasing means also may be on an outer surface of the first connector housing, and a rear wall of the accommodation space is substantially flush with the rear end surface of the first connector housing. Accordingly, the shape of the rear end of the first connector housing can be simplified.

The operable portion preferably is guided by being in sliding contact with edges of the notch.

The invention also is directed a method for assembling a connector. The connector has at least first and second connector housings that are connectable with each other. The method comprises assembling a slider into the first connector housing such that the slider is movable along connecting and separating directions of the connector housings. The method then comprises resiliently or elastically displacing an engaging portion in the second connector housing between first and second positions when the connector housings are properly connected. An operable portion enables movement of the slider to a position where displacement of the resilient engaging portion to the first position is permitted, and the operable portion is inserted into a notch of the second connector housing while being held in sliding contact therewith.

The slider is engaged with the resilient engaging portion in the first position and is moved back both at an intermediate stage of a connecting operation and at an intermediate stage of a separating operation. When the connector housings are connected properly, the resilient engaging portion is not engageable with the slider along the connecting and separating directions. Thus, the resilient engaging portion is displaced to the second position and the slider is moved forward.

The operable portion preferably is guided by sliding contact with edges of the notch.

These and other objects, features and advantages of the present invention will become more apparent upon reading of the following detailed description of preferred embodiments and accompanying drawings. It should be understood that even though embodiments are separately described, single features thereof may be combined to additional embodiments.

BRIEF DESCRIPTION OF THE DRAWINGS

FIGS. 3(A) and 3(B) are sections showing a state where the lock arm is freed from the biasing forces and the slider is returned to its initial position after connection of the two housings and a state where the lock arm is returned to its disengaging position after connection of the two housings, respectively.

DETAILED DESCRIPTION OF THE RELATED ART

Figure 1A:
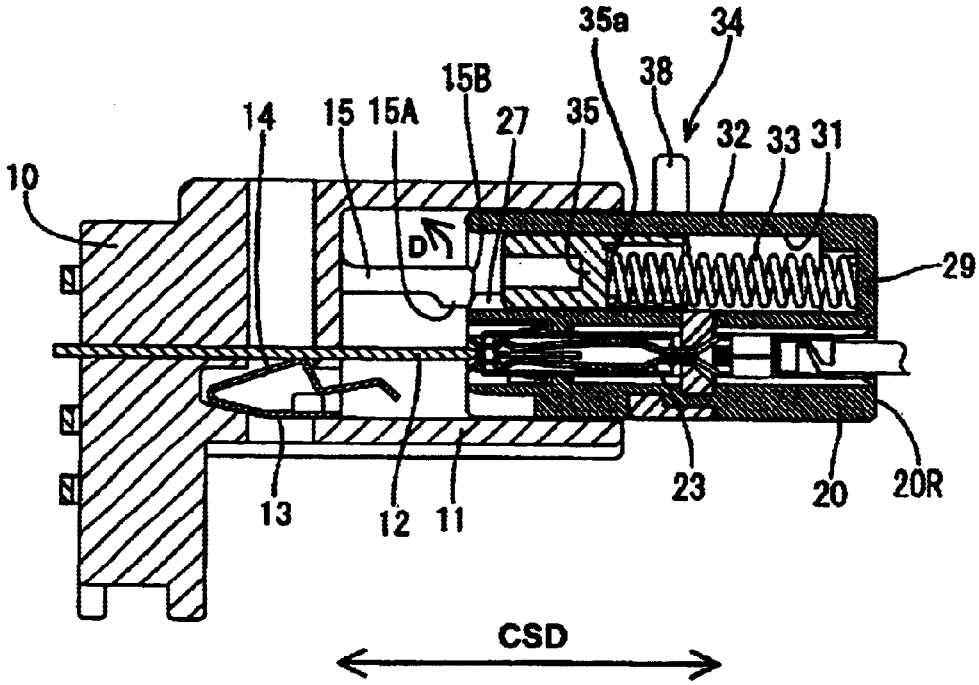
FIGS. 1(A) and 1(B) are sections showing a state of compression coil springs at the start of connection of male and female housings and a state of a lock arm in its disengaging position after the start of connection of the two housings, respectively.

A connector according to the invention is comprised of a male housing 10 and a female housing 20 that are connectable to each other. Ends of the housings 10, 20 that are to be connected with each other are referred to herein as the front ends.

The male housing 10 is formed e.g. of a synthetic resin and has a rectangular tubular receptacle 11 that projects forward toward the female housing 20. The front of the female housing 20 is configured to fit into the receptacle 11. However, the rear end of the female housing 20 projects out from the receptacle 11 when the housings 10, 20 are connected.

Four male terminal fittings 12 project side-by-side from a back wall of the male housing 10 and into the receptacle 11. Of course, more or fewer terminal fittings may be provided in other embodiments. A shorting terminal 13 is accommodated in the back wall of the male housing 10 below the male terminal fittings 12 and is provided with resilient or elastic contact pieces 14 that align with the respective male terminal fittings 12. The terminal contact pieces 14 are held resiliently in contact with the respective male terminal fittings 12 to short the male terminal fittings 12 when the housings 10, 20 are separated. Thus, there is no potential difference between the respective male terminal fittings 12 when the housings 10, 20 are separated.

A lock arm 15 is cantilevered forwardly from the widthwise center of the back wall of the male housing 10 and is disposed above the male terminal fittings 12. The lock arm 15 projects slightly more forward than the male terminal fittings 12, and is resiliently or elastically deformable vertically about its base end in the direction D in FIGS. 1 to 4. The direction D is substantially normal to the connecting and separating directions CSD of the housings 10, 20. A hook 15A projects down from the front end of the lock arm 15.

A notch 16 is formed through the upper wall of the receptacle 11 and extends rearwardly from the front of the male housing 10 at a location substantially centrally between the sides of the male housing 10. The notch 16 is substantially rectangular and has opposite lateral guiding edges 16G that are substantially parallel with the connecting and separating directions CSD of the two housings 10, 20.

The female housing 20 is formed into a substantially block shape from a synthetic resin. Cavities 21 corresponding in number to the male terminal fittings 12 are formed substantially side by side in the female housing 20 and extend forwardly from a rear end surface 20R of the female housing 20. Female terminal fittings 23 are connected with ends of wires 22 and are accommodated in the respective cavities 21 from behind. A retainer 24 then locks the female terminal fittings 23 in the cavities 21. An engaging recess 25 is formed at the front end of the bottom wall of the female housing 20 and is engageable with the respective resilient contact pieces 14 of the shorting terminal 13 in the male housing 10. A pushing portion 26 is defined at the front end of the ceiling surface of the engaging recess 25 for smoothly deforming the resilient contact pieces 14 of the shorting terminal 13 down and away from the male terminal fittings 12.

Figure 4:
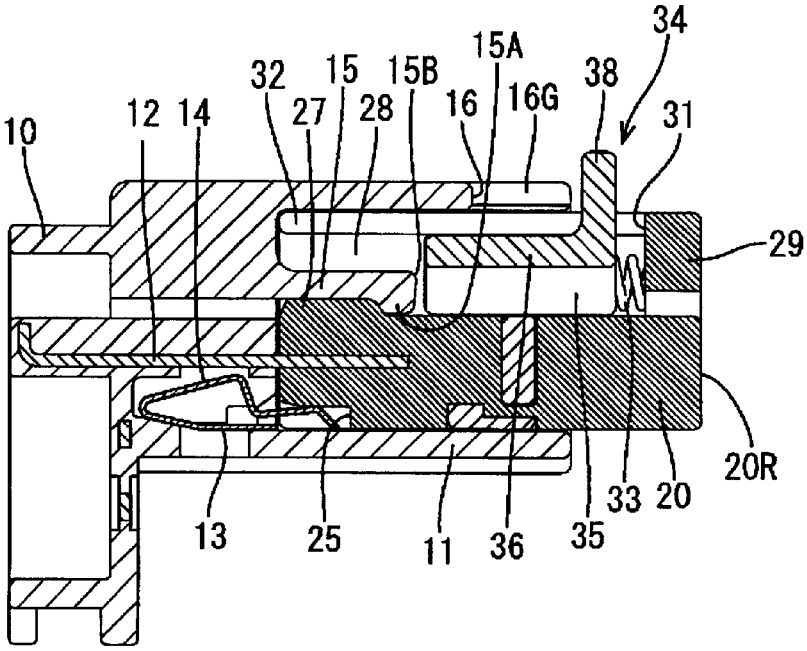
FIG. 4 is a section showing a state where the slider is moved backward to permit a displacement of the lock arm to its engaging position with the two housings connected with each other.
Figure 5:
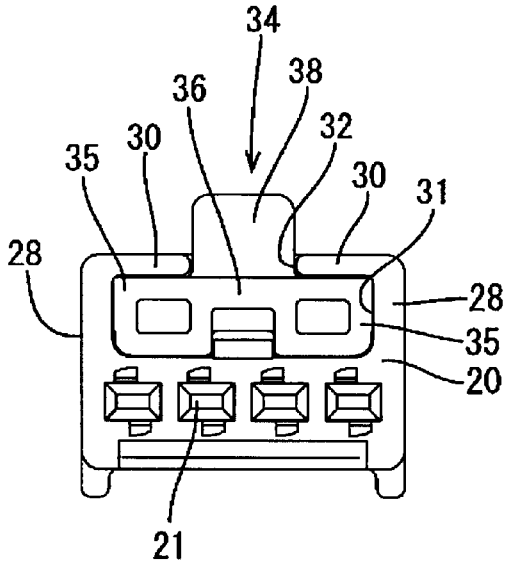
FIG. 5 is a front view of the female housing.
Figure 4A:
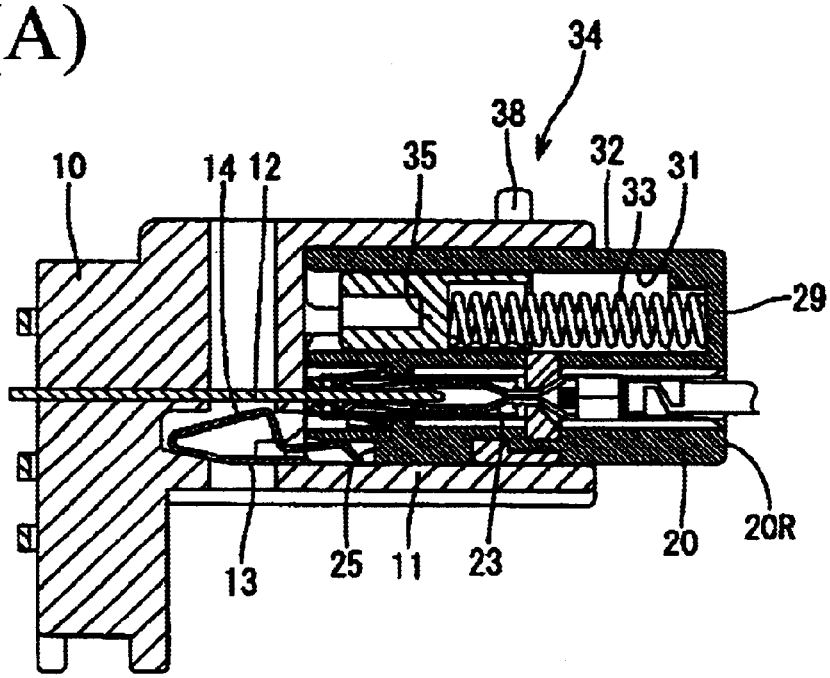
Figure 4B:
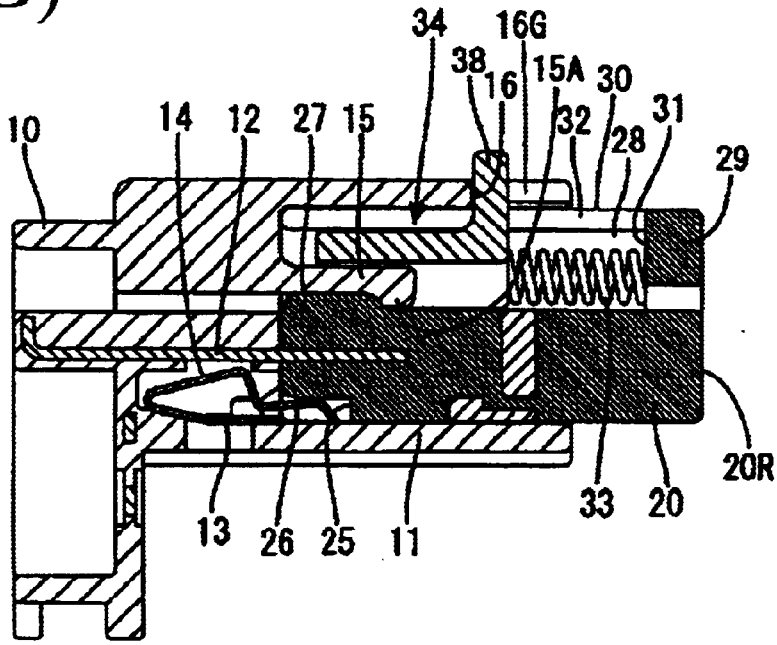
Figure 6:
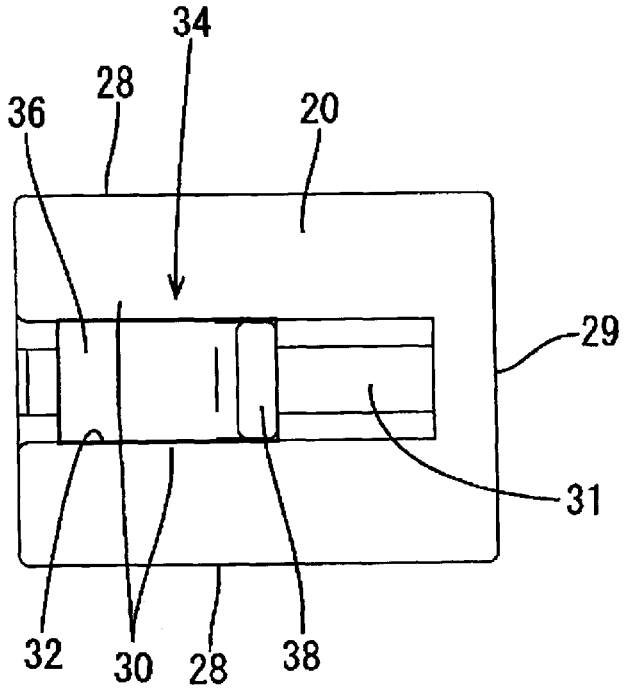
FIG. 6 is a plan view of the female housing.
Figure 7:
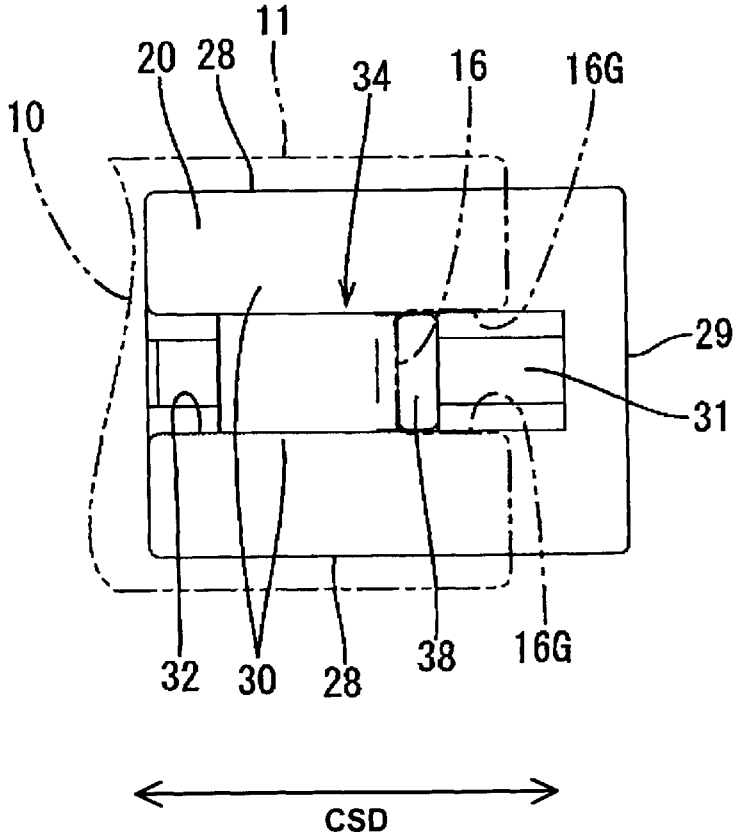
FIG. 7 is a plan view of the two housings connected with each other.
Figure 8:
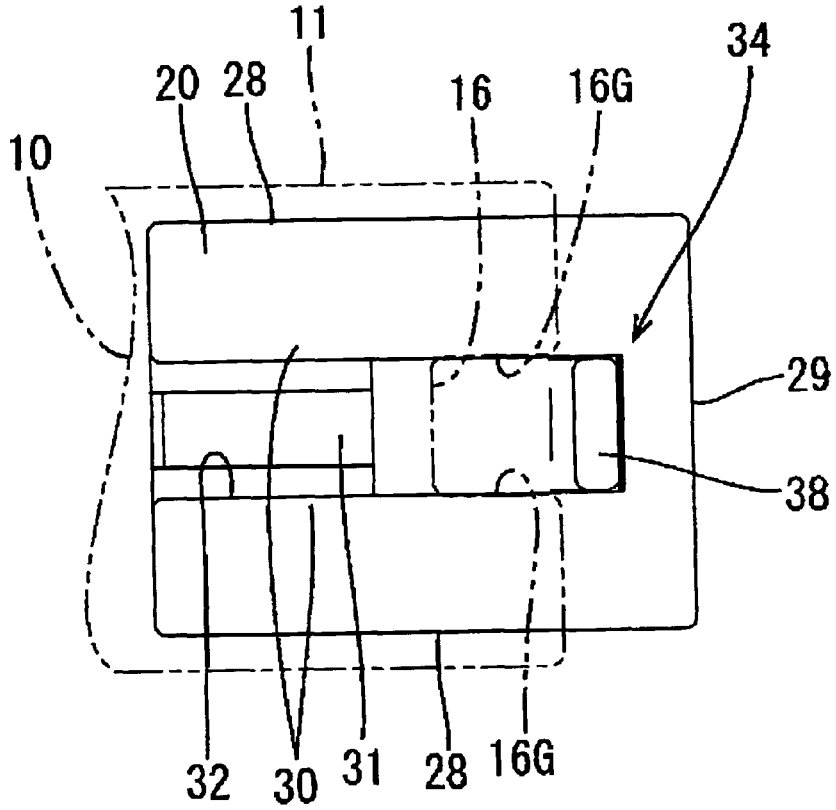
FIG. 8 is a plan view showing a state where the slider is moved backward with the two housings connected with each other.
Figure 9:
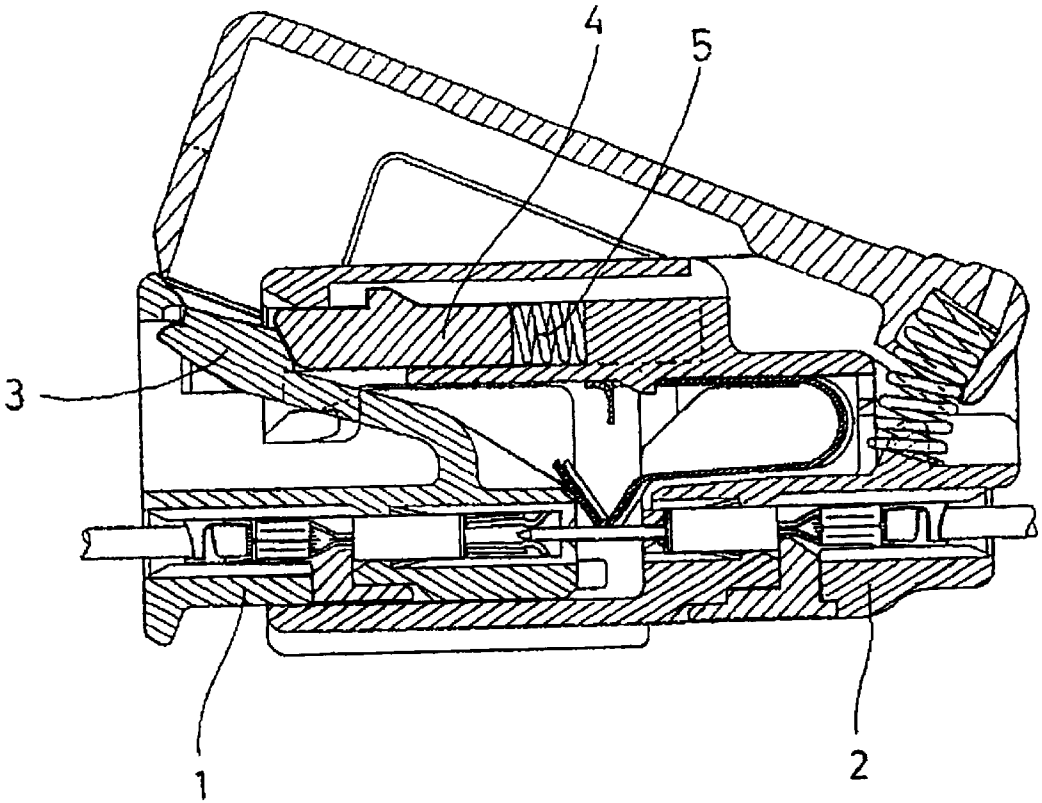
FIG. 9 PRIOR ART
FIG. 9 is a side view in section of a prior art connector.

A bulge 27 is formed at the widthwise center of the upper surface of the female housing 20 and projects up to the same height as lower surface areas of the lock arm 15 of the male housing 10 rearward of the hook 15A. Thus, the bulge 27 overlaps the hook 15A along the connecting and separating direction CSD. The rear surface of the bulge 27 is engaged with the hook 15A of the lock arm 15 when the housings 10, 20 are connected properly with each other, as shown in FIGS. 3(B) and 4. The engaging surfaces of the hook 15A and the bulge 27 are sloped moderately upward to the left in FIGURES, thereby forming a releasable locking construction. Thus, a separating force on the housings that exceeds a specified minimum separating force causes the slanted surfaces of the hook 15A and the bulge 27 to slide along one another and causes the lock arm 15 to deform resiliently upward and out of the locked engagement with the bulge 27.

Left and right side walls 28 project up from opposite lateral sides of the female housing 20. A rear wall 29 projects up from the rear end surface 20R of the female housing 20 and connects the side walls 28. Additionally, protection walls 30 extend in from the upper ends of the side walls 28 so that rear ends of the protection walls 30 connect with the rear wall 29. Thus, an accommodation space 31 is defined on the upper surface of the female housing 20 and is substantially enclosed by the side walls 28, the rear wall 29 and the protection walls 30. The accommodation space 31 is open to the front, and an escape groove 32 is defined between the two protection walls 30 to define an upward opening from the accommodation space 31.

Coil springs 33 and a slider 34 are mounted into the accommodation space 31 from the front. The slider 34 is configured to be moved in sliding contact with inner surfaces of the accommodation space 31 along forward and rearward directions parallel to the connecting and separating directions CSD of the housings 10, 20. The slider 34 is formed of a synthetic resin and has spring accommodating portions 35 and a coupling portion 36 that extends between the spring accommodating portions 35. The spring accommodating portions 35 have rearwardly open recesses 35*a* that accommodate front ends of the coil springs 33. The coils springs 33 extend rearwardly from the recesses 35*a* to the rear wall 29 of the accommodation space 31, and are compressed slightly in the condition shown in FIG. (1A). Rearward movement of the slider 34 into the position shown in FIG. 2(A) causes the coil springs 33 to compress resiliently and to accumulate larger spring forces.

Stopper projections (not shown) project from opposite side surfaces of the slider 34 and are fitted in stopper grooves (not shown) in the side walls 28 for forward and backward movement along the connecting and separating direction CSD. The stopper projections engage the front end surfaces of the stopper grooves to define the front limit position shown in FIGS. 1 and 3 where the front end surface of the slider 34 is retracted slightly from the front end surface of the female housing 20.

Figure 1B:
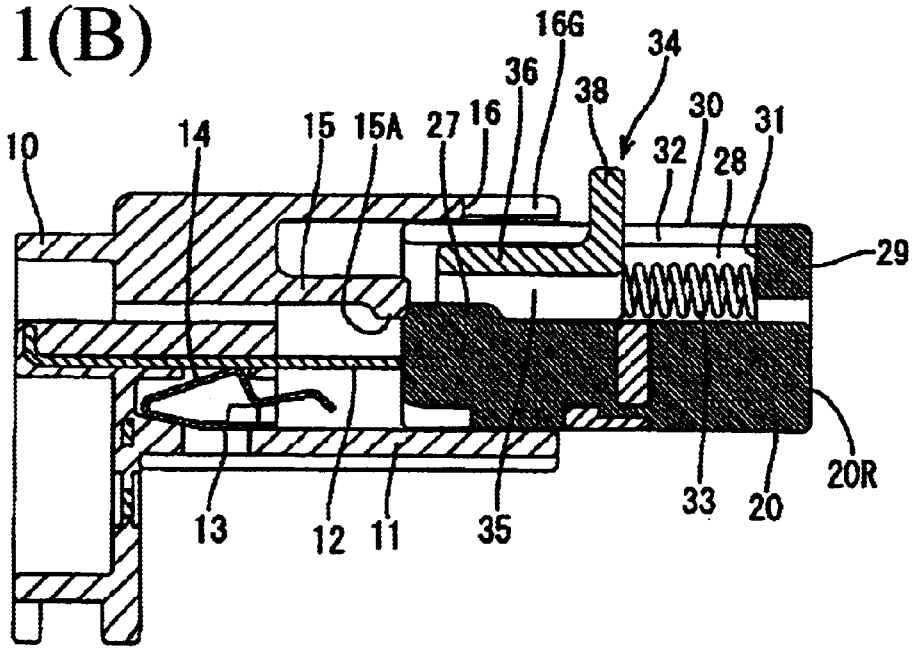

The bottom surface of the coupling portion 36 of the slider 34 is aligned with the upper surface of the lock arm 15 along the connecting and separating directions CSD when the lock arm 15 is in its undeformed state, as shown in FIGS. 1 and 3. However, the lock arm 15 can be deformed resiliently upward in the direction D and into the engaging position of FIG. 2 where the front surface of the lock arm 15 is aligned to engage the front surface of the coupling portion 36. A resilient return of the lock arm 15 to the undeflected condition enables the coupling portion 36 of the slider 34 to slip over the lock arm 15 and into a disengaging position where the coupling portion 36 prevents an upward deflection of the lock arm 15. Thus, the lock arm 15 is sandwiched between the coupling portion 36 of the slider 34 and the bulge 27 of the female housing 20 when the housings 10, 20 are connected, as shown in FIG. 3. Accordingly, the coupling portion 36 prevents the lock arm 15 from being deformed in a direction that would permit separation of the housings 10, 20.

The slider 34 is formed with an operable portion 38 for moving the slider 34 from a position where a deflection of the lock arm 15 is restricted to a position where such a displacement of the lock arm 15 is permitted. The operable portion 38 projects up from the rear end of the coupling portion 36 of the slider 34 and passes through the notch 16 of the receptacle 11 during connection of the two housings 10, 20. The operable portion 38 is at the front end of the notch 16 and the slider is at its front limit position when the housings 10, 20 are connected properly. Thus, the lock arm 15 is held in its disengaging position above the lock arm 15. However, the operable portion 38 can be moved back from the front end of the notch 16. Opposite side edges of the operable portion 38 are held in sliding contact with the guiding edges 16G of the notch 16 to restrict a loose transverse movement of the slider 34.

Figure 2A:
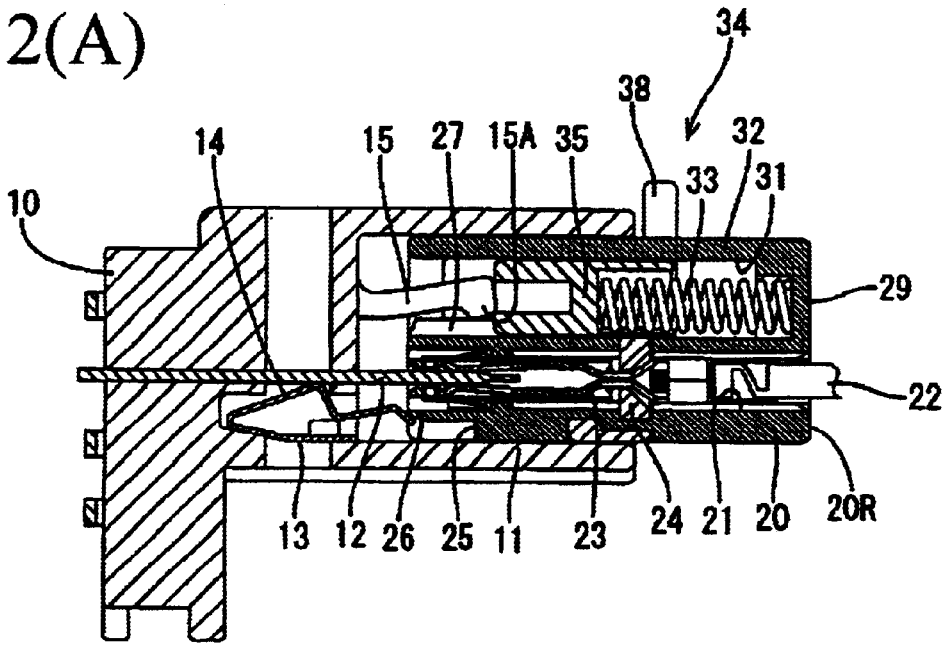
FIGS. 2(A) and 2(B) are sections showing a state where a slider is pushed by the lock arm to accumulate biasing forces in the compression coil springs during connection of the two housings and a state where the lock arm is resiliently displaced to its engaging position during connection of the two housings, respectively.
Figure 2B:
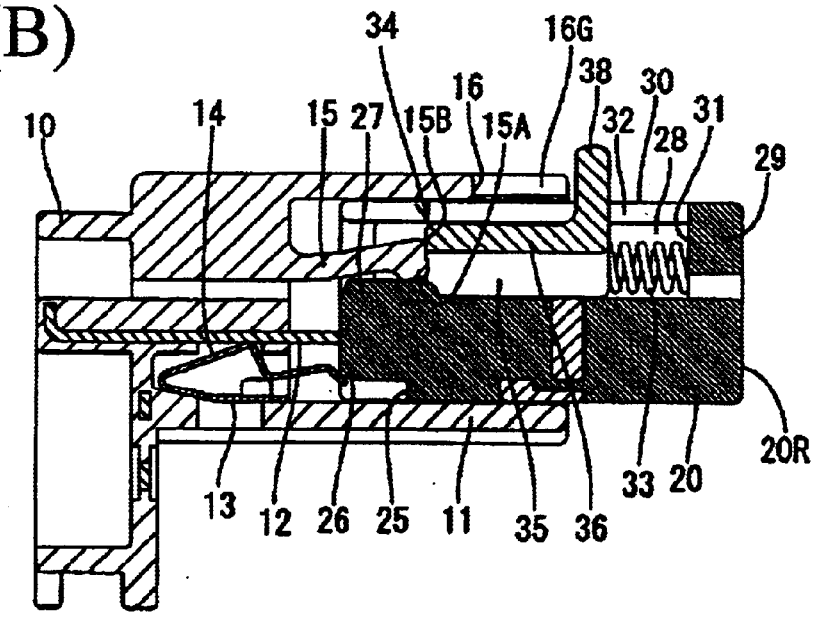

The housings 10, 20 are connected by aligning the front ends of the housings 10, 20 with each other and then inserting the front end of the female housing 20 into the receptacle 11 of the male housing 10. The lock arm 15 engages the front surface of the bulge 27, as shown in FIG. 1, before the male terminal fittings 12 enter the cavities 32 of the female housing 20. As a result, the lock arm 15 is deformed resiliently into the engaging position and moves onto the upper surface of the bulge 27. The front surface of the lock arm 15 then engages the front surface of the coupling portion 36 of the slider 34 at a position slightly retracted from the front surface of the bulge 27. If connection proceeds further from this state, the terminal fittings 12, 23 start contacting and the lock arm 15 pushes the slider 34 back, as shown in FIG. 2(A). The rearward movement of slider 34 resiliently compresses the coil springs 33.

The connecting operation may be interrupted halfway. In such a case, the spring forces accumulated in the compressed coil springs 33 are released, and the forwardly biased slider 34 pushes the lock arm 15 to separate the housings 10, 20 from each other. This prevents the housings 10, 20 from being kept partly connected.

The hook 15A passes the bulge 27 when the two housings 10, 20 are fitted to proper depth. Thus, the lock arm 15 is restored resiliently to the disengaging position and the hook 15A is brought into engagement with the bulge 27, as shown in FIG. 3. Simultaneously, the slider 34 is disengaged from the lock arm 15 and moves forward by the release of the spring forces accumulated in the coil springs 33. The slider 34 moves forward until the stopper projections contact the front ends of the stopper grooves. Thus, the slider 34 is at the forward position it occupied before the housings 10, 20 were connected. However, the coupling portion 36 of the slider 34 now covers the lock arm 15 over substantially its entire length to prevent the lock arm 15 from being deformed upward and away from the disengaging position. The lock arm 15 and the bulge 27 are engaged and the slider 34 prevents the lock arm 15 from being deformed in unlocking direction. Therefore, the housings 10, 20 are locked firmly together. Further, the engaging recess 25 of the female housing 20 is engaged with the resilient contact pieces 14 of the shorting terminal 13 to deform the contact pieces 14 down and away from the male terminal fittings 12. As a result, the shorted state of the male terminal fittings 12 is canceled.

The operable portion 38 of the slider 34 enters the notch 16 of the receptacle 11 at a point during connection of the housings 10, 20 after the shorting terminal 13 is deformed. As connection of the housings 10, 20 proceeds, the operable portion 38 is moved to the back of the notch 16 while its opposite side surfaces are held in sliding contact with the guiding edges 16G. The operable portion 38 reaches a front end position of the notch 16 when the connection of the housings 10,20 is complete.

The housings 10, 20 may require separation for maintenance or some other reason. In such a case, the operable portion 38 is pushed backward in the notch 16 while being held in sliding contact with the guiding edges 16G. As a result, the slider 34 is moved backward and the coil springs 33 are compressed. The rearward movement of the operable portion 38 causes the coupling portion 36 of the slider 34 to be moved back to a position where it is no longer above the lock arm 15. Thus, a displacement of the lock arm 15 from the disengaging position to the engaging position is permitted as shown in FIG. 4. The rearward movement of the slider 34 compresses the coil springs 33 against the rear wall 29 of the accommodation space 31. Thus, the entire female housing 20 is pushed backward. The female housing 20 is urged away from the male housing 10 by this pushing force and, accordingly, the lock arm 15 automatically is deformed upward or in disengagement direction by the slanted surfaces of the hook 15A and the bulge 27. Thus, the hook 15A moves onto the upper surface of the bulge 27 to effect unlocking. The female housing 20 then can be pulled in this state. The respective resilient contact pieces 14 of the shorting terminal 13 are disengaged from the engaging recess 25 during this process and move resiliently into contact again with the respective male terminal fittings 12. The separating operation can be performed easily because the operating direction of the slider 34 and the separating direction of the female housing 20 in which the slider 34 is mounted coincide with each other.

The separating operation may also be interrupted halfway. If the separating operation is interrupted with the hook 15A of the lock arm 15 moved onto the bulge 27, the spring forces accumulated in the resiliently compressed coil springs 33 are released, thereby moving the slider 34 forward and striking it against the front end surface of the lock arm 15 in the engaging position. As a result, the housings 10, 20 are separated forcibly.

The separating operation may be interrupted in a state where the female housing 20 is moved slightly in the disengaging direction D from its connected state. Thus, the lock arm 15 and the bulge 27 may still be engaged slightly. In this situation, the slider 34 is biased by the coil springs 33 and strikes against a slanted beveled portion 15B at the upper front end of the lock arm 15. Consequently, the lock arm 15 is pressed from above by the resilient forces of the coil springs 33 and the inclination of the beveled portion 15B. As a result, the lock arm 15 is returned to its disengaging position and the two housings 10, 20 are returned to their properly connected state. Upon reaching such a state, the separating operation is performed again. In this way, the housings 10, 20 are prevented from being left partly connected during a separating operation.

As described above, partial connection of the housings 10, 20 can be detected during both a connecting operation and a separating operation.

Further, the operable portion 38 can slide in contact with the guiding edges 16G of the notch 16. Therefore, the operable portion 38 is guided to move the slider 34 smoothly both forward and backward. Furthermore, the upper wall surrounds opposite sides of the operable portion 38, and hence external matter is not likely to interfere with the operable portion 38.

The operable portion 38 is at the rear of the slider 34. Thus, the notch 16 of the receptacle 11 can be short as compared to a case where the operable portion 38 is at a more forward position on the slider 34. Therefore, the receptacle 11 is stronger.

The outer surface of the rear wall 29 of the accommodation space 31 is continuous and flush with the rear end surface 20R of the female housing 20. Consequently, the shape of the rear end of the female housing 20 is simple.

The invention is not limited to the above described and illustrated embodiment. For example, the following embodiments also are embraced by the present invention other changes can be made without departing from the scope of the invention as defined by the claims.

In the foregoing embodiment, the slider 34 and the coil springs 33 are mounted in the female housing 20 and the lock arm 15 is in the male housing 10. However, the slider and the biasing means may be in the male housing and the resilient engaging portion may be in the female housing.

Although the operable portion is at the rear end of the slider, it may be at a front or a middle position with respect to forward and backward directions.

What is claimed is:

1. A connector having first and second connector housings that are connectable with each other, comprising:

a slider assembled into the first connector housing and being movable forward and backward substantially along connecting and separating directions of the connector housings, a resilient engaging portion provided in the second connector housing and being resiliently displaceable between a first position and a second position when the connector housings are properly connected, wherein:

the slider comprises an operable portion extending transverse to the connecting and separating directions for moving the slider to a position where a displacement of the resilient engaging portion to the first position is permitted, the second connector housing comprises a notch disposed and configured for slideably receiving the operable portion, and an accommodation space defined by opposite side walls and a rear wall being formed on an outer surface of the first connector housing and accommodating the slider therein.

2. The connector of claim 1, wherein the resilient engaging portion is resiliently displaceable in a direction intersecting the connecting and separating directions between the first position where the resilient engaging portion is engageable with the slider along the connecting and separating directions and the second position where the resilient engaging portion is disengaged from the slider along the connecting and separating directions.

3. The connector of claim 1, wherein the second connector housing comprises a receptacle into which the first connector housing is fittable, the notch being provided in the receptacle.

4. The connector of claim 1, further comprising a biasing means for biasing the slider forwardly, and wherein the resilient engaging portion is configured to engage the slider when the resilient engaging portion is in the first position for moving the slider backward against a biasing force of the biasing means, both at an intermediate stage of an operation of connecting the connector housings and at an intermediate stage of an operation of separating the connector housings.

5. The connector of claim 4, wherein, when the connector housings are properly connected with each other, the resilient engaging portion is disengaged from the slider and resiliently displaced to the second position and wherein the slider is moved forward by the release of the biasing force accumulated in a biasing means.

6. The connector of claim 5, wherein the notch extends substantially along the connecting and separating directions of the connector housings from a front end of the receptacle.

7. The connector of claim 3, wherein the accommodation space for at least partly accommodating the slider and biasing means is provided on an outer surface of the first connector housing, and a rear wall thereof is substantially flush with the rear end surface of the first connector housing.

8. The connector of claim 1, wherein the operable portion is provided at a rear end position of the slider.

9. The connector of claim 1, wherein the operable portion is guided by at least one edge of the notch.

10. A connector comprising:

a male housing having a front end, a receptacle at the front end and a resilient engaging portion projecting into the receptacle, a notch formed through an upper wall of the receptacle and extending rearwardly from the front end;

a female housing configured for insertion into and removal from the receptacle along connecting and separating directions, a bulge disposed for locked engagement with the resilient engaging portion when the housings are connected, opposite side walls projecting from an outer surface of the female housing and aligned parallel to the connecting and separating directions, a rear wall extending transversely between the connecting and separating directions and connecting rear ends of the opposite side walls, such that an accommodation space is defined between the opposite side walls, the rear wall and the bulge, a slider disposed in the accommodation space of the female housing and being movable along the connecting and separating directions from a front position where deflection of the resilient engaging portion is prevented to a rear position where deflection of the resilient engaging the portion is permitted, said slider having an operable portion slideably disposed in the notch and being engageable for moving the resilient engaging portion to the rear position.

11. The connector of claim 10, further comprising a biasing means for biasing the slider forwardly, and wherein the resilient engaging portion is configured to engage the slider when the resilient engaging portion is in a first position for moving the slider backward against a biasing force of the biasing means, both at an intermediate stage of connecting the connector housings and at an intermediate stage separating the connector housings.

12. The connector of claim 10, further comprising opposite protecting walls extending toward one another from the respective side walls and connected to the rear wall, the protecting walls being separated from one another by a groove aligned to receive the operable portion.

13. The connector of claim 12, comprising first and second coil springs between the rear wall and the slider and disposed on opposite respective sides of the bulge, the coil springs being dimensioned for biasing the slider forwardly.

* * * * *